US008360551B2

(12) United States Patent
Kagata et al.

(10) Patent No.: US 8,360,551 B2
(45) Date of Patent: Jan. 29, 2013

(54) INK-JET RECORDING APPARATUS, RECORDING METHOD, AND FLUSHING METHOD

(75) Inventors: Takayoshi Kagata, Shiojiri (JP); Tsuyoshi Sano, Shiojiri (JP); Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 224 days.

(21) Appl. No.: 12/836,894

(22) Filed: Jul. 15, 2010

(65) Prior Publication Data

US 2011/0012956 A1 Jan. 20, 2011

(30) Foreign Application Priority Data

Jul. 16, 2009 (JP) ..... 2009-167645

(51) Int. Cl.
*B41J 2/165* (2006.01)

(52) U.S. Cl. ..... 347/36; 347/28

(58) Field of Classification Search ..... 347/28, 347/30, 33, 35, 36
See application file for complete search history.

(56) References Cited

U.S. PATENT DOCUMENTS

2007/0257956 A1 11/2007 Akase et al.
2010/0026749 A1 2/2010 Kagata et al.

FOREIGN PATENT DOCUMENTS

JP 2002-086762 A 3/2002
JP 2008-044337 A 2/2008
JP 2009-000891 A 1/2009
JP 2010-030244 A 2/2010

*Primary Examiner* — Lamson Nguyen
(74) *Attorney, Agent, or Firm* — Nutter McClennen & Fish LLP; John J. Penny, V.

(57) ABSTRACT

An ink-jet recording apparatus includes an ink-jet recording head having a nozzle from which ink is ejected on the basis of print data, an ink-receiving unit that receives the ink ejected from the nozzle, and a surface-tension-depressant-solution supplying unit that supplies a liquid composition containing a surface tension depressant to the ink-receiving unit when the ink is ejected from the nozzle into the ink-receiving unit.

10 Claims, 5 Drawing Sheets

INK-JET RECORDING APPARATUS, RECORDING METHOD, AND FLUSHING METHOD

BACKGROUND

1. Technical Field

The present invention relates to an ink-jet recording apparatus that alleviates at least one of contamination of recording media and ink mixing resulting from maintenance such as flushing or cleaning.

2. Related Art

An ink-jet recording apparatus generally executes flushing, for example, to prevent defective printing due to drying of nozzles of a recording head (for stabilization of menisci). This action wastes ink from the nozzles by ejection irrespective of recording control signals. The unused ink ejected from the nozzles by flushing is typically received by a capping unit that seals the nozzle surface of the recording head and is then transferred, as waste ink, to a waste ink tank provided in the ink-jet recording apparatus by a suction device (see, for example, JP-A-2009-891 (Patent Document 1)).

On the other hand, one known type of ink-jet recording apparatus equipped with a serial recording head executes flushing on the movement path of the recording head without moving the recording head to the capping unit for improved print throughput (see, for example, JP-A-2002-86762 (Patent Document 2)). For example, this apparatus includes a paper guide, for transporting recording paper, that has openings through which ejected ink is received by a liquid-receiving unit (flushing box) disposed under the paper guide.

For example, flushing is executed every predetermined period during printing to prevent clogging, with thickened ink, of nozzle orifices having fewer ink droplets ejected therefrom.

On the other hand, if the nozzles of the recording head become clogged, the ink-jet recording apparatus executes cleaning, in which the capping unit seals the nozzles of the recording head and the suction device, connected to the capping unit, forcedly discharges ink from the nozzles. The unused ink ejected from the nozzles by cleaning is received by the capping unit and is then transferred, as waste ink, to the waste ink tank provided in the ink-jet recording apparatus by the suction device (see, for example, JP-A-2008-44337 (Patent Document 3)).

The flushing box is usually disposed as close to the nozzle surface as possible. If the opening side of the flushing box is distant from the nozzle surface of the recording head, ink droplets ejected from the recording head become airborne in the form of mist under air resistance before being received by the flushing box, thus contaminating the ambient environment.

As printing has diversified recently, inks containing colorants such as pigments or hollow resin particles have been used for higher reproducibility. It is known, however, that inks containing colorants such as pigments or hollow resin particles, or high-solid-content inks, do not easily permeate a waste ink absorber, such as a porous member, disposed in the flushing box; only solvent and water permeate the absorber, with the colorant deposited on the surface of the absorber.

Therefore, a pile of colorant may be deposited in the flushing box after long-term use. This ink deposit may contact the backside of a recording medium, thus contaminating the recording medium.

On the other hand, as described above, the unused ink ejected from the nozzles by flushing may also be received by the capping unit. Connected to the capping unit is the suction device, which can apply negative pressure by suction to an inner space defined by the capping unit and the nozzle surface. The ink received by the capping unit during flushing is sucked into the waste ink tank at the timing of cleaning for forcedly discharging the ink from the recording head. A problem arises, however, in that inks containing colorants such as pigments or hollow resin particles tend to foam upon suction because they contain a large amount of component, such as surfactant, for improving colorant dispersibility. It has been revealed that the resulting foam contaminates the nozzle surface and thereby causes ink mixing.

Focusing on the phenomenon that pigment ink discharged from the capping unit into the waste ink tank through a waste ink tube foams and, as a result, is less easily absorbed by the absorber provided in the waste ink tank, the invention disclosed in Patent Document 1 improves the absorbency of the absorber by impregnating at least part of the surface of the absorber that contacts waste ink with an impregnating solution containing a defoamer.

The technique disclosed in Patent Document 1, however, is not intended to alleviate foaming inside the capping unit. A fundamental solution has therefore been demanded to contamination of the nozzle surface due to foaming.

SUMMARY

An advantage of some aspects of the invention is that it provides an ink-jet recording apparatus that alleviates at least one of contamination of recording media and ink mixing resulting from maintenance such as flushing or cleaning.

An ink-jet recording apparatus according to a first aspect of the invention includes an ink-jet recording head having a nozzle from which ink is ejected on the basis of print data, an ink-receiving unit that receives the ink ejected from the nozzle, and a surface-tension-depressant-solution supplying unit that supplies a liquid composition containing a surface tension depressant to the ink-receiving unit when the ink is ejected from the nozzle into the ink-receiving unit.

Ink ejected during maintenance such as flushing or cleaning is received by the ink-receiving unit. The ink-receiving unit may be a liquid-receiving unit disposed on the movement path of the recording head to receive ink droplets during flushing (hereinafter also referred to as "flushing box") or a capping unit that seals a nozzle surface of the recording head. In general, an ink-receiving unit such as a flushing box or a capping unit contains a waste ink absorber, such as a porous member, to facilitate absorption of ejected ink and prevent it from being scattered. For an ink containing a colorant such as a pigment or hollow resin particles, however, a problem arises in that the colorant tends to be deposited on the surface of the waste ink absorber. Another problem is that an ink-receiving unit, such as a capping unit, having a suction device connected thereto causes the ink to foam upon suction because it contains an additive, such as a surfactant, for improving colorant dispersibility.

In contrast, the ink-jet recording apparatus according to the first aspect of the invention has the mechanism by which the surface-tension-depressant-solution supplying unit supplies the liquid composition containing the surface tension depressant (hereinafter referred to as "surface tension depressant solution") to the ink-receiving unit when the ink is ejected from the nozzle into the ink-receiving unit during flushing or cleaning. The surface tension depressant solution lowers the solid content of the deposit on the surface of the waste ink absorber for improved wettability on the waste ink absorber and also reduces the amount of bubbles in the ink responsible for foaming upon suction. This alleviates at least one of contamination of recording media and ink mixing resulting from maintenance such as flushing or cleaning.

In the ink-jet recording apparatus according to the first aspect of the invention, preferably, the ink-jet recording head has a plurality of nozzles, and the surface tension depressant solution is ejected from at least one of the nozzles. Ejecting the surface tension depressant solution from the nozzle into the ink-receiving unit more significantly inhibits deposition and ink foaming upon suction.

In the ink-jet recording apparatus according to the first aspect of the invention, preferably, the capping unit includes a surface tension depressant solution supply port through which the surface-tension-depressant-solution supplying unit supplies the surface tension depressant solution to the capping unit during cleaning. Supplying the surface tension depressant solution through the supply port to the capping unit by means of a vacuum created in the capping unit during cleaning more significantly inhibits ink foaming upon suction.

In the ink-jet recording apparatus according to the first aspect of the invention, preferably, the surface tension depressant is a compound selected from the group consisting of alcohols, ethers, polyols, fatty acid esters, metallic soaps, phosphate esters, silicones, and nonionic surfactants. The use of such a compound provides a superior effect of inhibiting deposition and foaming.

In the ink-jet recording apparatus according to the first aspect of the invention, preferably, the content of the surface tension depressant in the surface tension depressant solution is 0.5% to 5% by mass. If the content of the surface tension depressant is 0.5% by mass or more, a sufficient defoaming effect is achieved. If the content of the surface tension depressant is 5% by mass or less, sufficient solubility is achieved.

In the ink-jet recording apparatus according to the first aspect of the invention, preferably, the surface tension depressant solution further contains 5% by mass or more of a diol having five or more carbon atoms. Containing 5% by mass or more of a diol having five or more carbon atoms improves the solubility of the surface tension depressant in the main solvent, namely, water, thus increasing the content of the surface tension depressant.

A flushing method, according to a second aspect of the invention, for an ink-jet recording apparatus including an ink-jet recording head having nozzles from which ink is ejected on the basis of print data includes ejecting a liquid composition containing a surface tension depressant from a nozzle different from the nozzles into a liquid-receiving unit when the ink is ejected from the nozzles into the liquid-receiving unit by flushing.

This flushing method inhibits deposition of the colorant in the liquid-receiving unit of the ink-jet recording apparatus after long-term use, thus alleviating contamination of recording media.

A recording method, according to a third aspect of the invention, for recording an image by ejecting ink onto a recording medium from a plurality of nozzles of an ink-jet recording head includes ejecting ink from the nozzles into a liquid-receiving unit by flushing, ejecting a liquid composition containing a surface tension depressant from a nozzle different from the nozzles into the liquid-receiving unit, and recording an image on a recording medium after the ejection of the ink and the liquid composition.

This recording method inhibits deposition of the colorant in the liquid-receiving unit of the ink-jet recording apparatus after long-term use, thus alleviating contamination of recording media.

BRIEF DESCRIPTION OF THE DRAWINGS

The invention will be described with reference to the accompanying drawings, wherein like numbers reference like elements.

DESCRIPTION OF EXEMPLARY EMBODIMENTS

An ink-jet recording apparatus, a flushing method, and a recording method according to an exemplary embodiment of the invention will now be described in detail with reference to the drawings.

Figure 1:
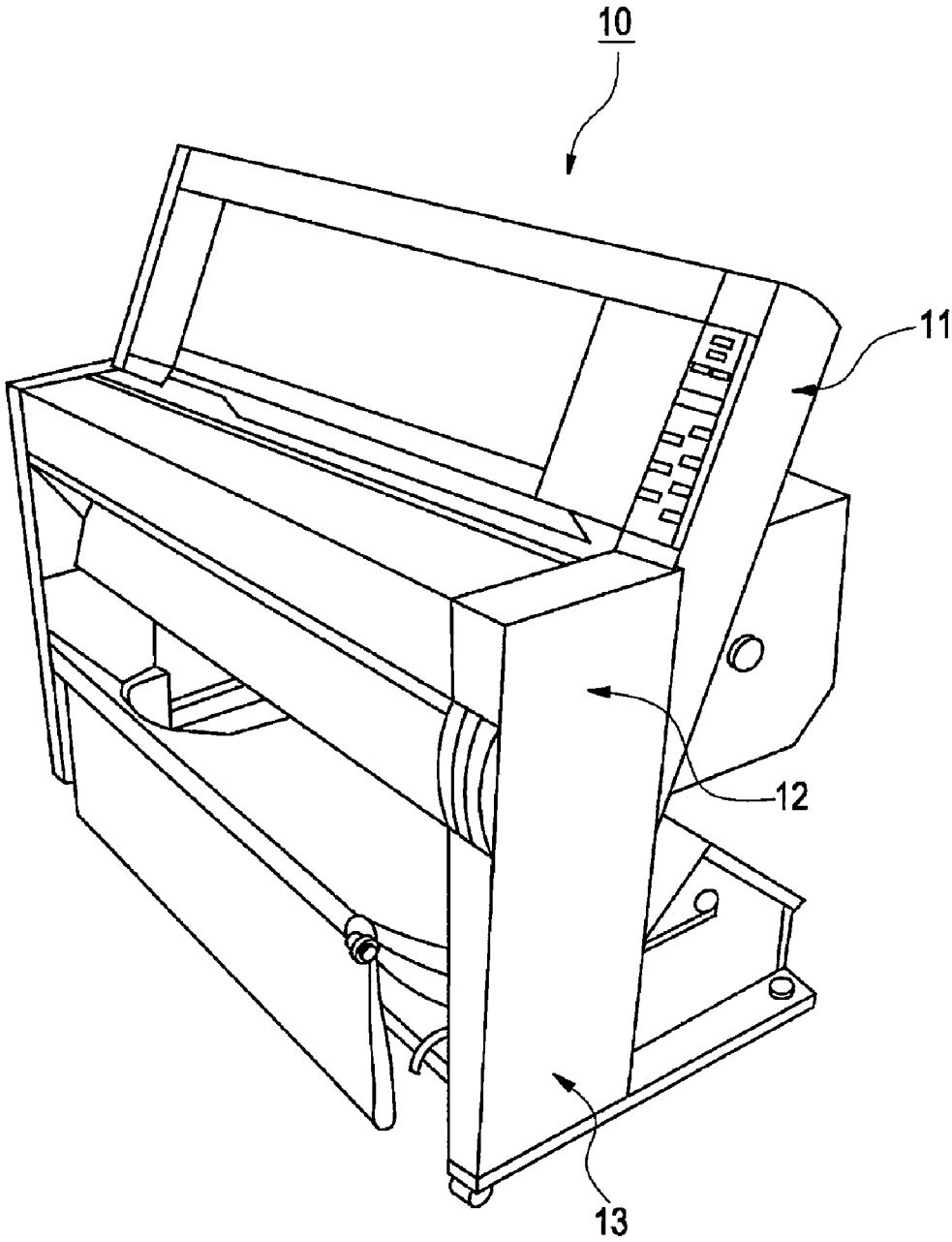
FIG. 1 is a schematic perspective view of an ink-jet recording apparatus according to an embodiment of the invention.
Figure 2:
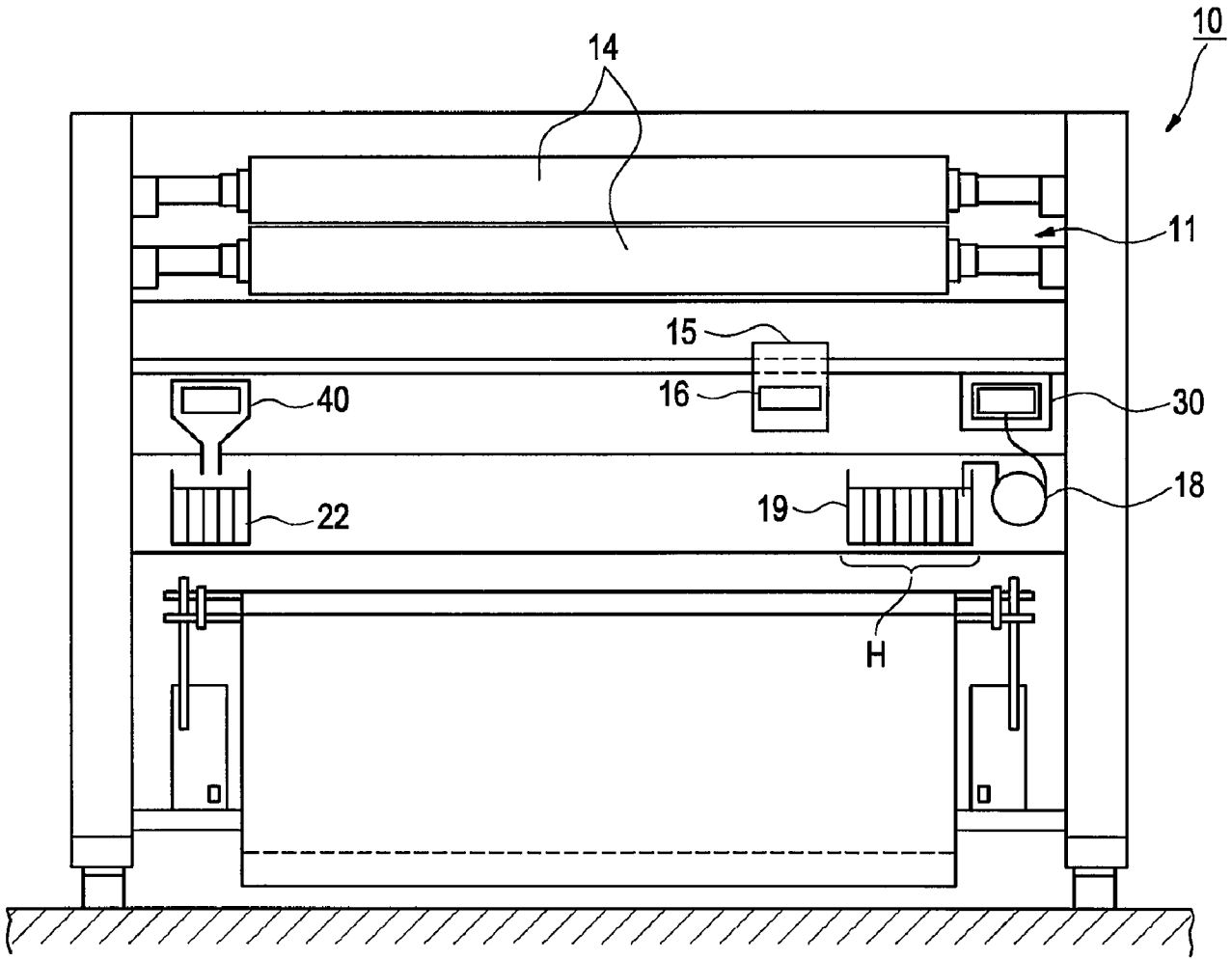
FIG. 2 is a schematic diagram showing the internal structure of the recording apparatus in FIG. 1.

FIG. 1 is a schematic perspective view of an ink-jet recording apparatus (hereinafter referred to as "recording apparatus") according to an exemplary embodiment of the invention. FIG. 2 is a schematic diagram showing the internal structure of the recording apparatus in FIG. 1.

As shown in FIG. 1, a recording apparatus 10 includes a paper-feeding section 11, a printing section 12, and an output stack section 13. A paper transport path is formed across the paper-feeding section 11, the printing section 12, and the output stack section 13 so as to extend substantially straight diagonally from the upper rear side to the lower front side.

As shown in FIG. 2, additionally, rolls of paper 14 are provided in the paper-feeding section 11 so as to be transported along the paper transport path. That is, the rolls of paper 14 are transported diagonally straight to the output stack section 13.

As shown in FIG. 2, additionally, a home position H serving as a non-printing region is formed at one end of a travelling region of a recording head 16 mounted on a carriage 15.

The recording head 16 has nozzles for ejecting ink and is mounted on the carriage 15 such that a nozzle surface thereof faces the paper transport path (that is, the nozzle surface is slightly tilted with respect to the vertical direction).

The recording apparatus 10 also includes a capping unit 30. The capping unit 30 is configured to seal the nozzle surface of the recording head 16 when the recording head 16 is located at the home position H.

As shown in FIG. 2, a suction pump 18 is provided under the capping unit 30 to apply negative pressure to the inner space of the capping unit 30.

In cleaning, in which the capping unit 30 is subjected to suction by the suction pump 18, ink clogging the nozzles or waste ink ejected into the capping unit 30 by flushing is discharged into a waste ink tank 19 and is then absorbed by a waste ink absorber 29 accommodated in the waste ink tank 19.

As shown in FIG. 2, additionally, the recording apparatus 10 includes a liquid-receiving unit 40 along the movement path of the recording head 16 to enable flushing at a position different from the capping unit 30. As described above, flushing does not eject ink onto the rolls of paper 14; it ejects a predetermined amount of ink from the nozzles every predetermined period to avoid, for example, thickening of ink in the nozzles. The liquid-receiving unit 40 contains a waste ink absorber (not shown). The ink ejected into the liquid-receiving unit 40 by flushing is received by a waste ink tank 22.

Thus, the recording apparatus 10 according to this embodiment allows the closer unit to be selected between the capping unit 30 and the liquid-receiving unit 40 as the flushing position when the recording head 16 executes flushing. This ensures print reliability by flushing without decreasing throughput.

Figure 3:
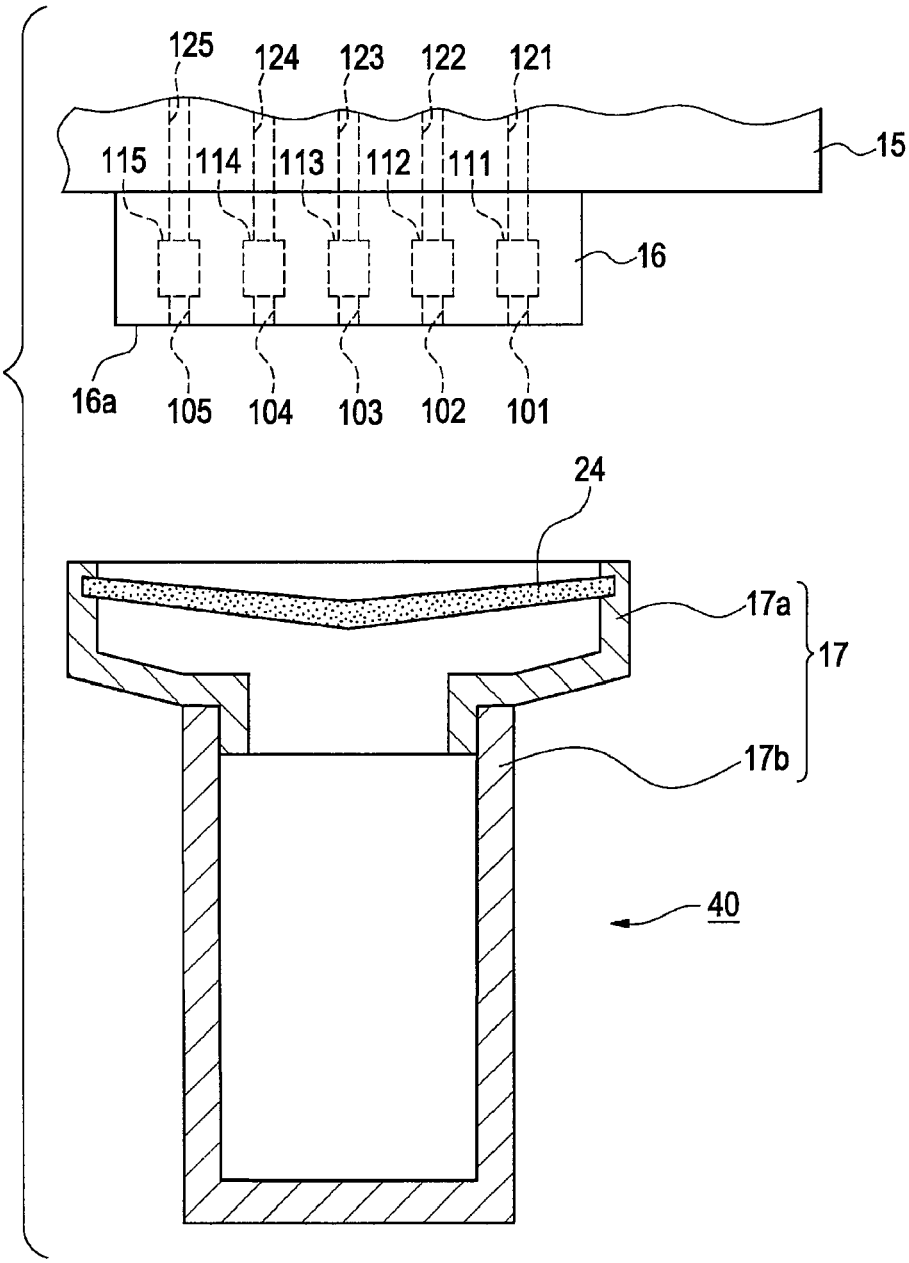
FIG. 3 is a schematic diagram of an example of a surface-tension-depressant-solution supplying unit of the recording apparatus according to the embodiment of the invention.

FIG. 3 is a schematic diagram of an example of a surface-tension-depressant-solution supplying unit of the recording apparatus 10 according to this embodiment, where the configuration in which the surface tension depressant solution is supplied to the liquid-receiving unit 40 shown in FIG. 2 during flushing will be illustrated. Whereas the liquid-receiving unit 40 and the waste ink tank 22 are separated from each other in FIG. 2, a waste ink storage portion corresponding to the waste ink tank 22 is integrated into the liquid-receiving unit 40 in FIG. 3.

The recording head 16 mounted on the carriage 15 has a plurality of nozzles including ink nozzles 102 to 105 and a surface tension depressant solution nozzle 101 for ejecting the surface tension depressant solution during maintenance such as flushing or cleaning. In addition, a variety of ink cartridges and a surface tension depressant solution cartridge (not shown) are detachably mounted above the recording head 16 on the carriage 15.

During flushing, inks are ejected from the ink cartridges into the liquid-receiving unit 40 through ink supply channels 122 to 125 by driving ink piezoelectric devices 112 to 115 provided in the recording head 16 for the respective ink nozzles. The liquid-receiving unit 40 includes a liquid receiver 17 and a waste ink absorber 24 disposed therein and formed of a porous material. The liquid receiver 17 includes a liquid entrance portion 17*a* having the waste ink absorber 24 fitted in a top opening thereof and a liquid storage portion 17*b* constituted by a closed-bottom rectangular vessel having a top opening. The liquid entrance portion 17*a* is attached to the liquid storage portion 17*b* such that the opening of the liquid storage portion 17*b* faces an opening at the bottom of the liquid entrance portion 17*a*. The liquid-receiving unit 40 is configured to approach a nozzle surface 16*a* of the recording head 16. The inks ejected into the liquid-receiving unit 40 by flushing are absorbed by the waste ink absorber 24 and are then received by the liquid storage portion 17*b* of the liquid receiver 17.

In this embodiment, the surface tension depressant solution is ejected from the surface tension depressant solution cartridge into the liquid-receiving unit 40 through a surface tension depressant solution supply channel 121 by driving a surface tension depressant solution piezoelectric device 111 provided in the recording head 16 for the surface tension depressant solution nozzle 101 at the same time as and/or after the ejection of the inks.

This process allows the waste ink to be received by the liquid storage portion 17*b* of the liquid receiver 17 without deposition of the colorants, such as pigments or hollow resin particles, on the surface of the waste ink absorber 24.

The number and arrangement of surface tension depressant solution nozzles 101 and the amount of surface tension depressant solution ejected may be appropriately selected depending on conditions such as the compositions of the inks used and the number of liquid-receiving units 40 mounted on the recording apparatus 10. Preferably, a surface tension depressant solution nozzle array is formed next to a nozzle array for ejecting ink compositions containing colorants such as pigments or hollow resin particles, or high-solid-content ink compositions, to more effectively inhibit the deposition.

Figure 4:
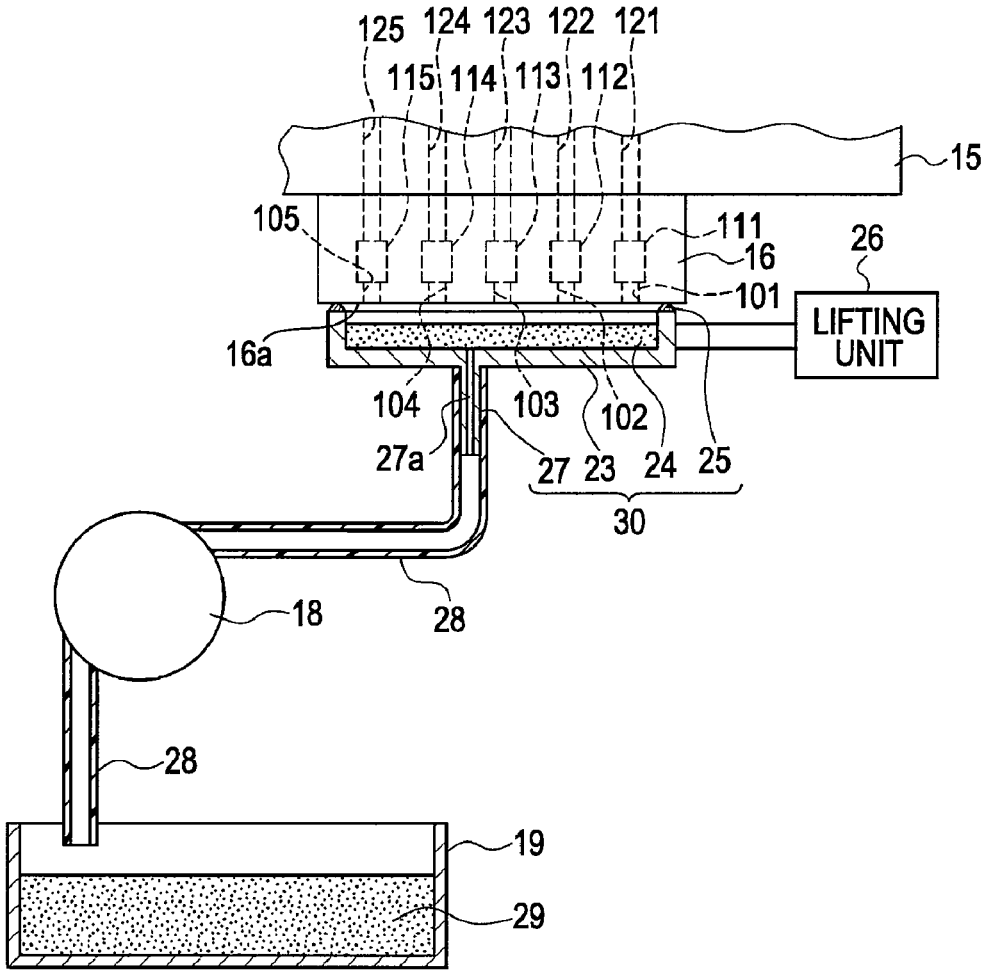
FIG. 4 is a schematic diagram of another example of the surface-tension-depressant-solution supplying unit of the recording apparatus according to the embodiment of the invention.

Flushing in the capping unit 30 using the same recording head 16 as in FIG. 3 will then be described along with cleaning following flushing with reference to FIG. 4.

The capping unit 30 includes a cap 23, a waste ink absorber 24, a sealing member 25, and a discharge portion 27.

The cap 23 is an open-top, closed-bottom rectangular box-shaped member, formed of synthetic resin, capable of sealing the nozzle surface 16*a* of the recording head 16. All the walls of the cap 23 (including the bottom and side walls) are uniform in thickness. The waste ink absorber 24 is a rectangular plate-shaped member formed of a flexible porous material and is provided in the cap 23 so as to cover the entire inner bottom surface of the cap 23. The sealing member 25 is a rectangular frame-shaped member formed of a flexible material such as rubber and is disposed in tight contact with the entire top surface of the cap 23.

The cap 23 is coupled to a lifting unit 26 for moving up and down the cap 23. With the carriage 15 moved to the non-printing region, the cap 23 is raised by the lifting unit 26 until the top surface of the sealing member 25 abuts the nozzle surface 16*a* of the recording head 16, thereby sealing the nozzles 101 to 105.

With the nozzle surface 16*a* sealed by the cap 23, the waste ink absorber 24 absorbs and retains ink in the cap 23 to maintain humidity in the inner space of the cap 23. Thus, the inks ejected into the cap 23 by flushing also function as a humectant in the inner space of the cap 23. The inks are discharged into the waste ink tank 19 by the suction pump 18 during cleaning, as described later.

The discharge portion 27 is disposed on the bottom surface of the cap 23 so as to extend downward and includes a discharge channel 27*a* for discharging the ink from the cap 23. Connected to the discharge portion 27 is a proximal end (upstream end) of a discharge tube 28 formed of a flexible material. The discharge tube 28 communicates with the cap 23 through the discharge channel 27*a*. A distal end (downstream end) of the discharge tube 28 is inserted into the rectangular waste ink tank 19. The suction pump 18 is provided in the middle of the discharge tube 28, serving as a suction device for producing suction from the cap 23 into the waste ink tank 19.

With the nozzle surface 16*a* of the recording head 16 (nozzles 101 to 105) sealed by the cap 23, cleaning is executed by driving the suction pump 18 so that thickened ink is sucked from the nozzles 101 to 105 together with, for example, bubbles and is discharged into the waste ink tank 19 through the cap 23 and the discharge tube 28. The waste ink tank 19 accommodates the waste ink absorber 29 for absorbing and retaining the ink discharged into the waste ink tank 19.

In this embodiment, the surface tension depressant is ejected from the surface tension depressant solution cartridge into the cap 23 through the surface tension depressant solution supply channel 121 by driving the surface tension depressant solution piezoelectric device 111 provided in the recording head 16 for the surface tension depressant solution nozzle 101 at the same time as and/or after the ejection of the inks during flushing.

This process allows the surface tension depressant (defoamer) to be mixed into the waste ink contained in the cap 23 in advance to inhibit foaming of the ink in the cap 23 upon suction. This inhibits contamination of the nozzles due to foaming, thus alleviating ink mixing.

Figure 5:
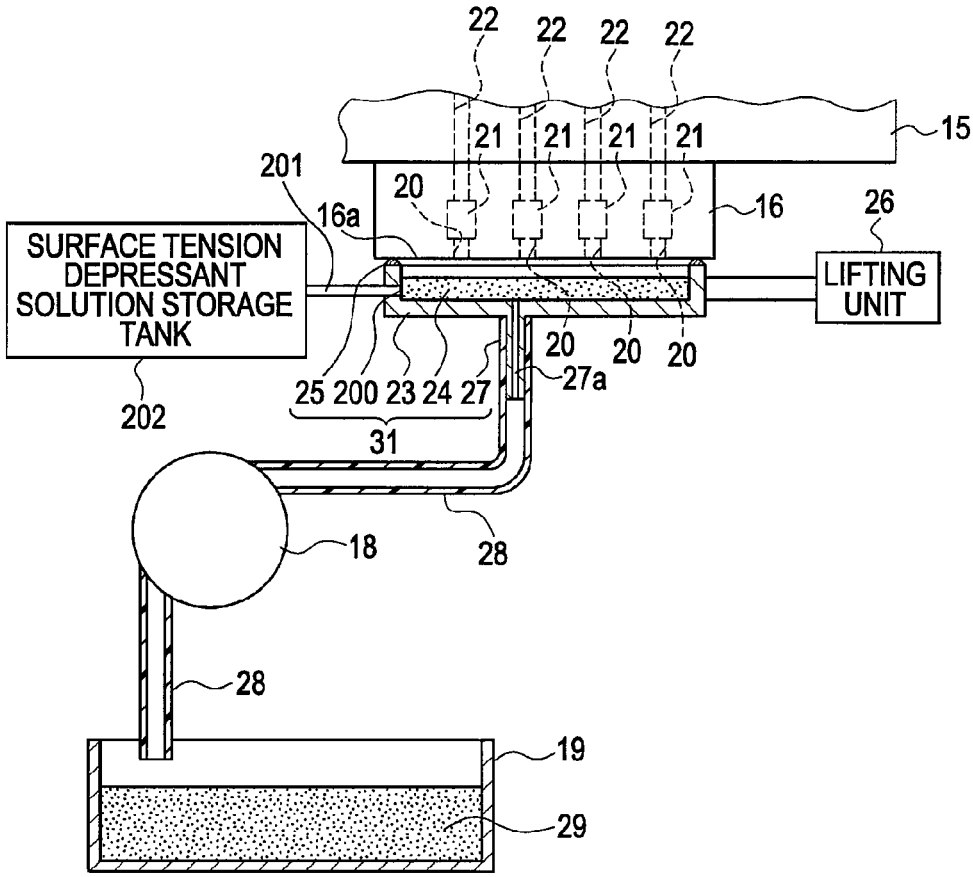
FIG. 5 is a schematic diagram of another example of the surface-tension-depressant-solution supplying unit of the recording apparatus according to the embodiment of the invention.

FIG. 5 is a schematic diagram of another example of the surface-tension-depressant-solution supplying unit of the recording apparatus 10 according to this embodiment, where the surface tension depressant solution is supplied to a capping unit 31 during cleaning.

The capping unit 31 includes a cap 23, a waste ink absorber 24, a sealing member 25, a discharge portion 27, and a surface tension depressant solution supply port 200.

A surface tension depressant solution storage tank 202 storing the surface tension depressant solution is connected to the cap 23 via a supply channel 201. The surface tension depressant is introduced into the cap 23 through the surface tension depressant solution supply port 200. The surface tension depressant solution supply port 200 is constituted by a supply valve (not shown).

With the nozzle surface 16*a* of the recording head 16 (constituted by nozzles 20) sealed by the cap 23, the suction pump 18 is driven so that thickened ink is sucked from the nozzles 20 together with, for example, bubbles and is discharged into the waste ink tank 19 through the cap 23 and the discharge tube 28. The supply valve constituting the surface tension depressant solution supply port 200 is opened by a vacuum created in the cap 23 during cleaning so that the surface tension depressant solution is supplied to the cap 23. This process allows the surface tension depressant (defoamer) to be mixed into the waste ink contained in the cap 23 to inhibit foaming of the ink in the cap 23 upon suction. This inhibits contamination of the nozzles due to foaming, thus alleviating ink mixing.

The amount of surface tension depressant solution supplied to the cap 23 may be appropriately selected depending on the compositions of the inks used, and may also be appropriately selected depending on other factors such as the installation position, material, and type of the surface tension depressant solution storage tank 202 and the material, type, and shape of the surface tension depressant solution supply port 200.

Liquid Composition Containing Surface Tension Depressant

A liquid composition, containing a surface tension depressant, used in the invention will now be described in detail.

The liquid composition, containing a surface tension depressant, used in the invention (surface tension depressant solution) is a liquid composition for inhibiting deposition and/or foaming upon suction of ink ejected from nozzles of an ink-jet recording head into an ink-receiving unit during flushing or cleaning. The surface tension depressant used in the invention is preferably a compound that is present at the liquid surface instead of the substance responsible for foaming and that has no effect of applying a repulsive force resisting thinning of bubble films (i.e., a defoamer). Examples of such surface tension depressants include alcohols, ethers, polyols, fatty acid esters, metallic soaps, phosphate esters, silicones, and nonionic surfactants. Among commercially available defoamers and compounds having such structures, those having deforming properties can be used alone or in combination, or as a mixture. Preferably, the surface tension depressant solution does not substantially contain a colorant such as a pigment or a dye.

Examples of alcohols include fatty acid alcohols having one to ten carbon atoms, such as methanol, ethanol, butanol, octynol, and 2-ethylhexanol.

Examples of ethers include ethylene glycol monophenyl ethers (such as di-t-diaminophenoxyethanol), ethylene glycol dialkyl ethers (such as 3-heptyl cellosolve and nonyl cellosolve), and diethylene glycol dialkyl ethers (such as 3-heptyl carbitol). Commercial products that can be used include Pionin K-17 (manufactured by Takemoto Oil & Fat Co., Ltd.) and Nopco DF122-NS (manufactured by San Nopco Limited).

Examples of polyols include compounds having many alkylene oxide groups (particularly, ethylene oxide groups) in the structure thereof (such as polyethers). These compounds have a superior effect of inhibiting foaming in the solution because they have superior dispersion stability in water. Commercial products of polyether defoamers that can be used include Adeka Pluronic series and Adekanol series LG-109, LG-121, LG-294, LG-297, etc. (manufactured by Adeka Corporation) and SN Defoamer 157, 247, 375, and 470 (manufactured by San Nopco Limited).

Examples of fatty acid esters include isoamyl stearate, succinate diesters, sorbitan monolaurate, sorbitan monooleate, sorbitan trioleate, oxyethylene sorbitan monolaurate, diethylene glycol distearate, and low-molecular-weight polyethylene glycol oleate.

Examples of metallic soaps include various organic acid metal salts such as naphthenic acid metallic soaps, synthetic acid metallic soaps, and stearic acid metallic soaps. One example is aluminum stearate, as typified by Naphthenate, Dicnate, and Stearate (all manufactured by DIC Corporation).

Examples of silicones include silicone oil defoamers, silicone compound defoamers, self-emulsified silicone defoamers, and silicone emulsion defoamers. Examples of silicone oil defoamers include common silicone oils having a dimethylpolysiloxane structure and modified silicone oils having partially modified methyl groups. Examples of modified silicone oils include amino-modified, epoxy-modified, carboxyl-modified, carbinol-modified, methacryl-modified, mercapto-modified, phenol-modified, heterogroup-modified, polyether-modified, methylstyryl-modified, alkyl-modified, higher-fatty-acid-ester-modified, hydrophilically modified, higher-alkoxy-modified, higher-fatty-acid-containing, and fluorine-modified silicone oils. Examples of commercial products include, as silicone oil defoamers, SH200 (manufactured by Dow Corning Toray Co., Ltd.) and KF96, KS604, and KI-6702 (manufactured by Shin-Etsu Chemical Co., Ltd.); as silicone compound defoamers, SN Defoamer 5016 (manufactured by San Nopco Limited) and SH5500 and SC5540 (manufactured by Dow Corning Toray Co., Ltd.); as self-emulsified silicone defoamers, BY28-503 (manufactured by Dow Corning Toray Co., Ltd.) and KS508, KS530, and KS-538 (manufactured by Shin-Etsu Chemical Co., Ltd.); and, as silicone emulsion defoamers, SM5511, SM5512, and SM5515 (manufactured by Dow Corning Toray Co., Ltd.) and KM72, KM73, and KM98 (manufactured by Shin-Etsu Chemical Co., Ltd.). Examples of commercial products of modified silicone oil defoamers include, as an amino-modified silicone oil defoamer, SF5417; as epoxy-modified silicone oil defoamers, SF8411 and SF8413; as a carboxyl-modified silicone oil defoamer, BY16-880; as a fluorine-modified silicone oil defoamer, FS1265 (all manufactured by Dow Corning Toray Co., Ltd.); as a polyether-modified silicone oil defoamer, KF-6017 (manufactured by Shin-Etsu Chemical Co., Ltd.); FORM BAN MS-575 (manufactured by Ultra Additives Inc.), which contains an alkyl-modified silicone and a polyether-modified silicone; and, as carbinol-modified silicone oil defoamers, KF-6001 and KF-6003 (manufactured by Shin-Etsu Chemical Co., Ltd.).

Examples of nonionic surfactants include the following:

(1) ethylene oxide adducts of alkyl aryl ethers;

(2) compounds represented by the formula:

$$HO—(C_2H_4O)_n—(C_3H_6O)_m—(C_2H_4O)_n—OH$$

and having a molecular weight of 500 to 10,000 and a $C_2H_4O$ content of 0% to 55%;

(3) alkyl esters represented by the formula:

$$R^1(R^2)CHCOO(C_2H_4O)_n$$

(wherein $R^1$ and $R^2$ are alkyl groups having one to ten carbon atoms and n is 1 to 8); and (4) acetylenic diols and 0 to 8 mol ethylene oxide adducts thereof.

Of the above surface tension depressants, silicones and nonionic surfactants are preferably used in the invention. The above surface tension depressants can be used alone or in combination of two or more, or as a mixture.

The content of the surface tension depressant is not particularly limited as long as it is sufficient to inhibit deposition and foaming of ink ejected from nozzles in an ink-receiving unit. Preferably, the surface tension depressant is contained in the surface tension depressant solution in an amount of 0.5% to 5% by mass to ensure the effect of inhibiting deposition and defoaming.

In addition to the surface tension depressant, the surface tension depressant solution used in the invention may contain, for example, a water-soluble solvent. Examples of water-soluble solvents include polyalcohols such as glycerol, 1,2,6-hexanetriol, ethylene glycol, propylene glycol, diethylene glycol, triethylene glycol, tetraethylene glycol, dipropylene glycol, polyethylene glycol, 2-butene-1,4-diol, 2-ethyl-1,3-hexanediol, 2-methyl-2,4-pentanediol, 1,2-octanediol, 1,2-hexanediol, 1,6-hexanediol, 2,5-hexanediol, 1,2-pentanediol, 1,5-pentanediol, and 4-methyl-1,2-pentanediol; alkyl alcohols having one to five carbon atoms, such as methyl alcohol, ethyl alcohol, n-propyl alcohol, isopropyl alcohol, n-butyl alcohol, sec-butyl alcohol, tert-butyl alcohol, isobutyl alcohol, and n-pentanol; glycol ethers such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol monoisopropyl ether, diethylene glycol monoisopropyl ether, ethylene glycol mono-n-butyl ether, diethylene glycol mono-n-butyl ether, triethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-t-butyl ether, propylene glycol mono-n-propyl ether, propylene glycol monoisopropyl ether, dipropylene glycol monomethyl ether, dipropylene glycol monoethyl ether, dipropylene glycol mono-n-propyl ether, dipropylene glycol monoisopropyl ether, propylene glycol mono-n-butyl ether, and dipropylene glycol mono-n-butyl ether; amides such as dimethylformamide and dimethylacetoamide; ketones and ketone alcohols such as acetone and diacetone alcohol; ethers such as dioxane; and other compounds such as 2-pyrrolidone, N-methyl-2-pyrrolidone, and sulfolane. These water-soluble solvents can be used alone or in combination of two or more. To inhibit drying of ink ejected into an ink-receiving unit, at least one of the water-soluble solvents is preferably a high-boiling-point, low-volatile solvent having a vapor pressure at 20° C. of 0.01 mmHg or less, more preferably 0.005 mmHg or less.

In addition to the surface tension depressant and the water-soluble solvent, the surface tension depressant solution used in the invention may contain, for example, a solid humectant, a pH adjuster, a surfactant, and a preservative or fungicide.

The solid humectant used may be one having a melting point of 20° C. or more and a solubility in water at 20° C. of 5% by weight or more. Examples of such solid humectants include alcohols such as 1,4-butanediol, 2,3-butanediol, and 2-ethyl-2-hydroxylmethyl-1,3-propanediol; esters such as ethylene carbonate; nitrogen compounds such as acetoamide, N-methylacetoamide, 2-pyrrolidone, ε-caprolactam, urea, thiourea, and N-ethylurea; and saccharides such as dihydroxyacetone, erythritol, D-arabinose, L-arabinose, D-xylose, 2-deoxy-β-D-ribose, D-lyxose, L-lyxose, D-ribose, D-arabitol, ribitol, D-altrose, D-allose, D-galactose, L-galactose, D-quinovose, D-glucose, D-digitalose, D-digitoxose, D-cymarose, L-sorbose, D-tagatose, D-talose, 2-deoxy-D-glucose, D-fucose, L-fucose, D-fructose, D-mannose, L-rhamnose, D-inositol, myo-inositol, D-glucitol, D-mannitol, methyl-D-galactopyranoside, methyl-D-glucopyranoside, methyl-D-mannopyranoside, N-acetylchitobiose, isomaltose, xylobiose, gentiobiose, kojibiose, chondrosin, sucrose, cellobiose, sophorose, α,α-trehalose, maltose, melibiose, lactose, laminaribiose, rutinose, gentianose, stachyose, cellotriose, planteose, maltotriose, melezitose, lacto-N-tetraose, and raffinose.

Examples of pH adjusters include alkali metal hydroxides such as lithium hydroxide, potassium hydroxide, and sodium hydroxide; and amines such as ammonia, triethanolamine, tripropanolamine, diethanolamine, and monoethanolamine. Other compounds can also be used as needed, including collidine, imidazole, phosphoric acid, 3-(N-morpholino)propanesulfonic acid, tris(hydroxylmethyl)aminomethane, and boric acid.

Examples of surfactants include anionic surfactants, cationic surfactants, amphoteric surfactants, and nonionic surfactants. Examples of nonionic surfactants include acetylene glycol surfactants; acetylene alcohol surfactants; ether surfactants such as polyoxyethylene nonyl phenyl ether, polyoxyethylene octyl phenyl ether, polyoxyethylene dodecyl phenyl ether, polyoxyethylene alkyl allyl ether, polyoxyethylene oleyl ether, polyoxyethylene lauryl ether, polyoxyethylene alkyl ether, and polyoxyalkylene alkyl ether; ester surfactants such as polyoxyethylene oleate, polyoxyethylene distearate, sorbitan laurate, sorbitan monostearate, sorbitan monooleate, sorbitan sesquioleate, polyoxyethylene monooleate, and polyoxyethylene stearate; silicone surfactants such as dimethylpolysiloxane; and fluorine-containing surfactants such as fluoroalkyl esters and perfluoroalkyl carboxylate salts. Of the above nonionic surfactants, acetylene glycol surfactants and acetylene alcohol surfactants are preferred for their low-foaming properties and superior deforming performance. Examples of acetylene glycol surfactants and acetylene alcohol surfactants include 2,4,7,9-tetramethyl-5-decyne-4,7-diol, 3,6-dimethyl-4-octyne-3,6-diol, and 3,5-dimethyl-1-hexyn-3-ol. Commercial products are also available, including Surfynol 104, 82, 465, 485, and TG (manufactured by Air Products and Chemicals, Inc.) and Olfine STG and Olfine E1010 (manufactured by Nissin Chemical Industry Co., Ltd.).

Examples of preservatives and fungicides include sodium benzoate, sodium pentachlorophenolate, sodium 2-pyridinethiol-1-oxide, sodium sorbate, sodium dehydroacetate, and 1,2-benzisothiazolin-3-on (such as Proxel BZ, Proxel BD20, Proxel GXL, Proxel XL2, and Proxel TN from Arch Chemicals Inc.).

The surface tension depressant solution used in the invention is preferably an aqueous solution, that is, a solution containing water as a main solvent. The surface tension depressant solution used in the invention can be prepared simply by mixing the surface tension depressant and optionally the water-soluble solvent with water.

In particular, the surface tension depressant solution used in the invention preferably contains 5% by mass or more of a diol having five or more carbon atoms to improve the solubility of the surface tension depressant in the main solvent, namely, water. Examples of diols having five or more carbon atoms include 1,5-pentanediol, 1,4-pentanediol, 1,3-pentanediol, 1,2-pentanediol, 2,3-pentanediol, 2,4-pentanediol, 1,6-hexanediol, 1,5-hexanediol, 1,4-hexanediol, 1,2-hexanediol, 2,5-hexanediol, 2,4-hexanediol, 2,3-hexanediol, 3,4-hexanediol, 1,7-heptanediol, 1,6-heptanediol, 1,5-heptanediol, 1,4-heptanediol, 1,3-heptanediol, 1,2-heptanediol, 2,6-heptanediol, 2,5-heptanediol, 2,4-heptanediol, 2,3-heptanediol, 3,5-heptanediol, 3,4-heptanediol, 1,8-octanediol, 1,2-octanediol, 1,9-nonanediol, 1,10-decanediol, 1,2-decanediol, 1,12-dodecanediol, 1,2-dodecanediol, 1,2-cyclohexanediol, 1,3-cyclohexanediol, 1,4-cyclohexanediol, 1,2-cyclopentanediol, 1,3-cyclopentanediol, 1,2-cyclooctanediol, 1,5-cyclooctanediol, 5-norbornene-2,2-dimethanol, and 5-norbornene-2,3-dimethanol.

The water-soluble solvent, the solid humectant, the pH adjuster, the surfactant, and/or the preservative described above may be used alone or as a mixed solution. Their mixing ratios may be appropriately determined depending on, for example, the type of ink composition used, and are not particularly limited as long as their intended effects are provided. For example, although the pH adjuster must be added in such an amount that the overall pH of the mixed solution is 7 or more, other conditions may be appropriately determined depending on, for example, the type of ink composition used. The preservative may be added in any amount sufficient to ensure its preservation effect.

Ink Composition

An ink composition commonly used for ink-jet recording can be applied to an ink-jet recording apparatus according to the invention. In particular, an ink-jet recording apparatus according to the invention is suitable for use with an ink composition containing a pigment or hollow resin particles as a colorant. This is because an ink containing a pigment or hollow resin particles as a colorant has a high solid content and also contains large amounts of additives, such as a surfactant, responsible for foaming, thus easily causing deposition of the colorant or foaming. The ink composition is preferably aqueous.

An ink composition suitable for an ink-jet recording apparatus according to the invention will now be described in detail.

The pigment used may be an organic pigment, an inorganic pigment, or hollow resin particles commonly used for ink-jet ink compositions.

Examples of organic pigments include azo pigments (such as azo lakes, insoluble azo pigments, fused azo pigments, and chelate azo pigments), polycyclic pigments (such as phthalocyanine pigments, perylene pigments, perinone pigments, anthraquinone pigments, quinacridone pigments, dioxazine pigments, thioindigo pigments, isoindolinone pigments, and quinophthalone pigments), nitro pigments, nitroso pigments, and aniline black.

Examples of cyan pigments preferably used for cyan ink compositions include C.I. Pigment Blue 1, 2, 3, 15:3, 15:4, 15:6, 15:34, 16, 22, and 60; and C.I. Vat Blue 4 and 60. In particular, C.I. Pigment Blue 15:3 is preferred.

Examples of magenta pigments preferably used for magenta ink compositions include C.I. Pigment Red 5, 7, 12, 48(Ca), 48(Mn), 57(Ca), 57:1, 112, 122, 123, 168, 184, 202, 207, and 209; and C.I. Pigment Violet 19. In particular, C.I. Pigment Red 122 and C.I. Pigment Violet 19 are preferred.

Examples of yellow pigments preferably used for yellow ink compositions include C.I. Pigment Yellow 1, 2, 3, 12, 13, 14, 16, 17, 73, 74, 75, 83, 93, 95, 97, 98, 109, 110, 114, 128, 129, 138, 139, 147, 150, 151, 154, 155, 180, and 185.

Examples of inorganic pigments include metal compounds commonly used for ink-jet ink compositions, such as metal oxides, barium sulfate, and calcium carbonate. Examples of metal oxides include, but are not limited to, titanium dioxide, zinc oxide, silica, alumina, and magnesium oxide. Among metal compounds, titanium dioxide and alumina are preferred.

The hollow resin particles preferably have inner voids and outer shells formed of a liquid-permeable resin. With this structure, the inner voids are filled with an aqueous medium when the hollow resin particles are present in an aqueous ink composition. The particles filled with the aqueous medium can be stably dispersed in the aqueous ink composition without settling because they have nearly the same specific gravity as the external aqueous medium. This improves the storage stability and ejection stability of the ink composition.

When an ink composition containing hollow resin particles as a colorant is ejected onto a recording medium such as paper, the aqueous medium disappears from the particles during drying so that they become empty. The particles then appear white because they contain air and form resin and air layers having different refractive indices to effectively scatter incident light.

The hollow resin particles used in the invention are not particularly limited and may be of known type. For example, hollow resin particles disclosed in the specifications of U.S. Pat. No. 4,880,465 and Japanese Patent No. 3,562,754 are suitable.

The method for preparing the hollow resin particles is not particularly limited, and known methods can be used. For example, the method for preparing the hollow resin particles may be emulsion polymerization, in which a hollow resin particle emulsion is formed by stirring a mixture of a vinyl monomer, a surfactant, a polymerization initiator, and an aqueous dispersion medium under heating in a nitrogen atmosphere.

Examples of vinyl monomers include nonionic monoethylenically unsaturated monomers such as styrene, vinyltoluene, ethylene, vinyl acetate, vinyl chloride, vinylidene chloride, acrylonitrile, (meth)acrylamide, and (meth)acrylate esters. Examples of (meth)acrylate esters include methyl acrylate, methyl methacrylate, ethyl (meth)acrylate, butyl (meth)acrylate, 2-hydroxyethyl methacrylate, 2-ethylhexyl (meth)acrylate, benzyl (meth)acrylate, lauryl (meth)acrylate, oleyl (meth)acrylate, palmityl (meth)acrylate, and stearyl (meth)acrylate.

Polyfunctional vinyl monomers can also be used. Examples of polyfunctional vinyl monomers include divinylbenzene, allyl methacrylate, ethylene glycol dimethacrylate, 1,3-butanediol dimethacrylate, diethylene glycol dimethacrylate, and trimethylolpropane trimethacrylate. A monofunctional vinyl monomer and a polyfunctional vinyl monomer as shown above can be copolymerized and highly cross-linked to provide hollow resin particles having light-scattering properties as well as other properties such as heat resistance, solvent resistance, and dispersibility in solvents.

Examples of surfactants include various types of surfactants that form molecular assemblies such as micelles in water, including anionic surfactants, nonionic surfactants, cationic surfactants, and amphoteric surfactants.

Examples of polymerization initiators include known water-soluble compounds such as hydrogen peroxide and potassium persulfate.

Examples of aqueous dispersion media include water and water containing a hydrophilic organic solvent.

The content of the organic pigment in the ink composition used in the invention is preferably 0.1% to 20.0% by mass, more preferably 1.0% to 10.0% by mass, of the total amount of ink composition. If the content of the organic pigment exceeds 20.0% by mass, it may cause clogging of the ink-jet recording head and therefore impair its reliability. On the other hand, if the content of the organic pigment falls below 0.1% by mass, the color density tends to be insufficient.

The content of the inorganic pigment in the ink composition used in the invention is preferably 1.0% to 20.0% by mass, more preferably 5.0% to 10.0% by mass, of the total amount of ink composition. If the content of the inorganic pigment exceeds 20.0% by mass, it may cause clogging of the ink-jet recording head and therefore impair its reliability. On the other hand, if the content of the inorganic pigment falls below 1.0% by mass, the color density, such as whiteness, tends to be insufficient.

The mean particle size (outer diameter) of the inorganic pigment is preferably 30 to 600 nm, more preferably 200 to 400 nm. If the outer diameter exceeds 600 nm, the particles may settle and lose dispersion stability, and may also cause clogging of the ink-jet recording head and therefore impair its reliability. On the other hand, if the outer diameter falls below 30 nm, the color density, such as whiteness, tends to be insufficient.

The mean particle size of the inorganic pigment can be measured using a particle size distribution analyzer based on laser diffraction/scattering. An example of a laser diffraction particle size distribution analyzer that can be used is a particle size distribution analyzer based on dynamic laser scattering (such as "Microtrac UPA" manufactured by Nikkiso Co., Ltd.).

The content (solid content) of the hollow resin particles in the ink composition used in the invention is preferably 5% to 20% by mass, more preferably 8% to 15% by mass, of the total amount of ink composition. If the content (solid content) of the hollow resin particles exceeds 20% by mass, they may cause clogging of the ink-jet recording head and therefore impair its reliability. On the other hand, if the content falls below 5% by mass, the color density, such as whiteness, tends to be insufficient.

The mean particle size (outer diameter) of the hollow resin particles is preferably 0.2 to 1.0 μm, more preferably 0.4 to 0.8 μm. If the outer diameter exceeds 1.0 μm, the particles may settle and lose dispersion stability, and may also cause clogging of the ink-jet recording head and therefore impair its reliability. On the other hand, if the outer diameter falls below 0.2 μm, the color density, such as whiteness, tends to be insufficient. The inner diameter is preferably about 0.1 to 0.8 μm.

The mean particle size of the hollow resin particles can be measured using a particle size distribution analyzer based on laser diffraction/scattering. An example of a laser diffraction particle size distribution analyzer that can be used is a particle size distribution analyzer based on dynamic laser scattering (such as "Microtrac UPA" manufactured by Nikkiso Co., Ltd.).

The ink composition used in the invention preferably further contains a resin for binding the colorant. Examples of such resins include acrylic resins (such as ALMATEX (manufactured by Mitsui Chemicals, Inc.)) and urethane resins (such as WBR-022U (manufactured by Taisei Fine Chemical Co., Ltd.)).

The content of the binder resin is preferably 0.5% to 10% by mass, more preferably 0.5% to 3.0% by mass, of the total amount of ink composition.

The ink composition used in the invention preferably contains at least one compound selected from the group consisting of alkanediols and glycol ethers. Alkanediols and glycol ethers improve wettability on a recording surface of a recording medium, thus improving ink permeability.

Examples of preferred alkanediols include 1,2-alkanediols having four to eight carbon atoms, such as 1,2-butanediol, 1,2-pentanediol, 1,2-hexanediol, 1,2-heptanediol, and 1,2-octanediol. Of these, 1,2-alkanediols having six to eight carbon atoms, namely, 1,2-hexanediol, 1,2-heptanediol, and 1,2-octanediol, are more preferable for their particularly high permeability into recording media.

Examples of glycol ethers include lower alkyl ethers of polyalcohols, such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, dipropylene glycol monomethyl ether, dipropylene glycol monoethyl ether, triethylene glycol monomethyl ether, triethylene glycol monobutyl ether, and tripropylene glycol monomethyl ether. Of these, the use of triethylene glycol monobutyl ether provides superior recording quality.

The content of at least one compound selected from the group consisting of alkanediols and glycol ethers is preferably 1% to 20% by mass, more preferably 1% to 10% by mass, of the total amount of ink composition.

The ink composition used in the invention preferably contains an acetylene glycol surfactant or a polysiloxane surfactant. Acetylene glycol surfactants and polysiloxane surfactants improve wettability on a recording surface of a recording medium, thus improving ink permeability.

Examples of acetylene glycol surfactants include 2,4,7,9-tetramethyl-5-decyne-4,7-diol, 3,6-dimethyl-4-octyne-3,6-diol, 3,5-dimethyl-1-hexyn-3-ol, and 2,4-dimethyl-5-hexyn-3-ol. Commercial products of acetylene glycol surfactants are also available, including Olfine E1010, STG, and Y (manufactured by Nissin Chemical Industry Co., Ltd.) and Surfynol 104, 82, 465, 485, and TG (manufactured by Air Products and Chemicals, Inc.).

For polysiloxane surfactants, commercial products are available, including BYK-347 and BYK-348 (manufactured by BYK Japan KK).

The ink composition used in the invention may further contain another surfactant such as an anionic surfactant, a nonionic surfactant, or an amphoteric surfactant.

The content of the surfactant is preferably 0.01% to 5% by mass, more preferably 0.1% to 0.5% by mass, of the total amount of ink composition.

The ink composition used in the invention preferably contains a polyalcohol. When the ink composition used in the invention is applied to an ink-jet recording apparatus, the polyalcohol inhibits drying of the ink to prevent it from clogging an ink-jet recording head.

Examples of polyalcohols include ethylene glycol, diethylene glycol, triethylene glycol, polyethylene glycol, polypropylene glycol, propylene glycol, butylene glycol, 1,2,6-hexanetriol, thioglycol, hexylene glycol, glycerol, trimethylolethane, and trimethylolpropane.

The content of the polyalcohol is preferably 0.1% to 3.0% by mass, more preferably 0.5% to 2.0% by mass, of the total amount of ink composition.

The ink composition used in the invention preferably contains a tertiary amine. A tertiary amine functions as a pH adjuster that can be used to easily adjust the ph of the ink composition.

An example of a tertiary amine is triethanolamine.

The content of the tertiary amine is preferably 0.01% to 10% by mass, more preferably 0.1% to 2% by mass, of the total amount of ink composition.

Typically, the ink composition used in the invention preferably contains water as a solvent. The water used is preferably pure water or ultrapure water, such as ion exchange water, ultrafiltrated water, reverse osmosis water, or distilled water. In particular, such water is preferably sterilized by treatment such as ultraviolet irradiation or addition of hydrogen peroxide because it inhibits growth of mold and bacteria over an extended period of time.

The ink composition used in the invention may optionally contain additives, including a binder such as water-soluble rosin, a fungicide or preservative such as sodium benzoate, an antioxidant or ultraviolet absorber such as an allophanate, a chelating agent, and an oxygen absorber. These additives can be used alone or in a combination of two or more.

The ink composition used in the invention can be prepared using a known apparatus such as a ball mill, a sand mill, an attritor, a basket mill, or a roll mill. In the preparation, coarse particles are preferably removed through, for example, a membrane filter or a mesh filter.

The type of ink-jet recording may be any type of ink-jet recording, such as thermal ink-jet recording, piezoelectric ink-jet recording, or continuous ink-jet recording.

The invention will now be described in detail with reference to the examples below, although they should not be construed as limiting the invention.

Ink Compositions

First, ink compositions (Inks a to e) were prepared according to the compositions shown in Table 1 below, where the values are expressed in percent by mass.

TABLE 1

| | Inks | | | | |
|---|---|---|---|---|---|
| Ingredients | a | b | c | d | e |
| Pigment Yellow 74 | 3 | — | — | — | — |
| Pigment Violet 19 | — | 2 | — | — | — |
| Pigment Blue 15: 3 | — | — | 1.5 | — | — |
| White hollow resin microparticles | — | — | — | 10 | — |
| Titanium Dioxide | — | — | — | — | 10 |
| Urethane resin | 5 | 5 | 5 | 5 | 5 |
| Glycerol | 10 | 10 | 10 | 10 | 10 |
| 1,2-hexanediol | 3 | 3 | 3 | 3 | 3 |
| Triethanolamine | 0.5 | 0.5 | 0.5 | 0.5 | 0.5 |
| BYK-348 | 0.5 | 0.5 | 0.5 | 0.5 | 0.5 |
| Ion exchange water | Balance | Balance | Balance | Balance | Balance |
| Total | 100 | 100 | 100 | 100 | 100 |

The hollow resin particles used were the commercial product "SX8782(D)" (manufactured by JSR Corporation). This product is an aqueous dispersion containing hollow resin particles having an outer diameter of 1.0 μm and an inner diameter of 0.8 μm and having a solid content of 20.5%.

The titanium dioxide used was the commercial product "NanoTek® Slurry" (manufactured by C. I. Kasei Co., Ltd.). This product is a slurry containing titanium dioxide particles having a mean particle size of 36 nm in a solid content of 15%.

"BYK-348" (manufactured by BYK Japan KK) is a polysiloxane surfactant.

The urethane resin used was "WBR-022U" (manufactured by Taisei Fine Chemical Co., Ltd.).

Surface Tension Depressant Solutions

In addition, surface tension depressant solutions (Surface Tension Depressant Solutions f to k) were prepared according to the compositions shown in Table 2 below, where the values are expressed in percent by mass.

TABLE 2

| | Surface tension depressant solutions | | | | | |
|---|---|---|---|---|---|---|
| Ingredients | f | g | h | i | j | k |
| Surfynol 104PG | 0 | 0.1 | 0.3 | 0.5 | 1 | 3 |
| Glycerol | 20 | 20 | 20 | 20 | 20 | 20 |
| 1,2-hexanediol | 5 | 5 | 5 | 5 | 5 | 5 |
| Triethanolamine | 0.5 | 0.5 | 0.5 | 0.5 | 0.5 | 0.5 |
| BYK-348 | 0.5 | 0.5 | 0.5 | 0.5 | 0.5 | 0.5 |
| Ion exchange water | Balance | Balance | Balance | Balance | Balance | Balance |
| Total | 100 | 100 | 100 | 100 | 100 | 100 |

Surfynol 104PG is a compound having the following structure:

[Chemical Formula 1]

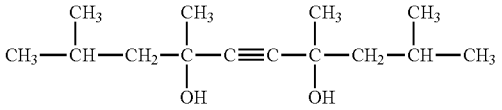

2,4,7,9-tetramethyl-5-decyne-4,7-diol

The ink compositions shown in Table 1 were charged into ink chambers of dedicated cartridges for an ink-jet printer ("PX-H8000," manufactured by Seiko Epson Corporation). The white ink compositions, namely, Inks d and e, were charged into photo black ink chambers. The surface tension depressant solutions shown in Table 2 were charged into matt black ink chambers and light gray ink chambers. The combinations of the ink compositions and the surface tension depressant solutions are shown in Table 3.

TABLE 3

| | | Ink compositions | | | | |
|---|---|---|---|---|---|---|
| | | a | b | c | d | e |
| Surface | f | Com. Ex. 1 | Com. Ex. 2 | Com. Ex. 3 | Com. Ex. 4 | Com. Ex. 5 |
| tension | g | — | — | — | Ref. Ex. 6 | — |
| depressant | h | — | — | — | Ref. Ex. 7 | — |
| solutions | i | Ex. 1 | Ex. 2 | Ex. 3 | Ex. 4 | Ex. 5 |
| | j | — | — | — | Ex. 6 | — |
| | k | — | — | — | Ex. 7 | — |

The ink cartridges thus prepared were attached to the printer for evaluation of deposition and foaming. For foaming, two evaluations were carried out: evaluation using the actual machine and evaluation using small amounts of samples. The methods and criteria for evaluation of deposition and foaming are as follows. The results are shown in Table 4.

Foaming Evaluation (Ink)

Inks a to e and Surface Tension Depressant Solutions f to k were mixed in equal amounts (30 mL+30 mL) and were shaken one hundred times in 100 mL glass sample tubes to evaluate the amount of bubbles occurring. The criteria were as follows:

AAA: Few bubbles occurred

AA: Fine bubbles occurred but disappeared within five seconds

A: Bubbles occurred but disappeared within one minute

B: Bubbles occurred and disappeared within 30 minutes

C: Bubbles occurred and persisted for more than 30 minutes

Foaming Evaluation (Actual Machine)

Ten sets of operations were carried out, each including cleaning ten times and printing once. As the print pattern used for the evaluation, one dot was ejected from each nozzle. The criteria for determining whether mixed colors occurred on prints were as follows:

A: The prints had no problem in all ten sets

B: The prints were affected in one or two out of the ten sets

C: The prints were affected in three or more out of the ten sets

Deposition Evaluation (Actual Machine)

Continuous printing involving flushing 3,000 times was carried out to determine the amount of deposit in the flushing box. The criteria were as follows:

AA: No deposit was observed after 3,000 times

A: A deposit was observed after 3,000 times but did not contact printing paper

B: A deposit contacted printing paper after 3,000 times

C: A deposit contacted printing paper after 1,000 times or less

TABLE 4

| | Ex. 1 | Ex. 2 | Ex. 3 | Ex. 4 | Ex.5 | Ex. 6 | Ex. 7 | Com. Ex. 1 |
|---|---|---|---|---|---|---|---|---|
| Foaming (ink) | A | A | A | A | A | AA | AAA | B |
| Foaming (actual machine) | A | A | A | A | A | A | A | B |
| Deposition | A | A | A | B | B | A | AA | C |

| | Com. Ex. 2 | Com. Ex. 3 | Com. Ex.4 | Com. Ex. 5 | Ref. Ex. 6 | Ref. Ex. 7 |
|---|---|---|---|---|---|---|
| Foaming (ink) | C | B | C | C | B | B |
| Foaming (actual machine) | C | B | C | C | B | B |
| Deposition | C | C | C | C | C | C |

What is claimed is:

1. An ink-jet recording apparatus comprising:

an ink-jet recording head including a nozzle from which ink is ejected on the basis of print data;

an ink-receiving unit that receives the ink ejected from the nozzle; and a surface-tension-depressant-solution supplying unit that supplies a liquid composition containing a surface tension depressant to the ink-receiving unit when the ink is ejected from the nozzle into the ink-receiving unit.

2. The ink-jet recording apparatus according to claim 1, wherein the ink-receiving unit is a liquid-receiving unit that receives ink droplets during flushing, the surface-tension-depressant-solution supplying unit supplying the liquid composition to the liquid-receiving unit during flushing.

3. The ink-jet recording apparatus according to claim 1, wherein the ink-receiving unit is a capping unit that seals a nozzle surface, the surface-tension-depressant-solution supplying unit supplying the liquid composition to the capping unit during flushing or cleaning.

4. The ink-jet recording apparatus according to claim 3, wherein the capping unit includes a liquid composition supply port through which the surface-tension-depressant-solution supplying unit supplies the liquid composition to the capping unit during cleaning.

5. The ink-jet recording apparatus according to claim 1, wherein the ink-jet recording head has a plurality of nozzles, the liquid composition being ejected from at least one of the nozzles.

6. The ink-jet recording apparatus according to claim 1, wherein the surface tension depressant is a compound selected from the group consisting of alcohols, ethers, polyols, fatty acid esters, metallic soaps, phosphate esters, silicones, and nonionic surfactants.

7. The ink-jet recording apparatus according to claim 6, wherein the content of the surface tension depressant in the liquid composition is 0.5% to 5% by mass.

8. The ink-jet recording apparatus according to claim 6, wherein the liquid composition further contains 5% by mass or more of a diol having five or more carbon atoms.

9. A flushing method for an ink-jet recording apparatus including an ink-jet recording head having nozzles from which ink is ejected on the basis of print data, the method comprising ejecting a liquid composition containing a surface tension depressant from a nozzle different from the nozzles into a liquid-receiving unit when the ink is ejected from the nozzles into the liquid-receiving unit by flushing.

10. A recording method for recording an image by ejecting ink onto a recording medium from nozzles of an ink-jet recording head, the method comprising:

ejecting ink from the nozzles into a liquid-receiving unit by flushing;

ejecting a liquid composition containing a surface tension depressant from a nozzle different from the nozzles into the liquid-receiving unit; and recording an image on a recording medium after the ejection of the ink and the liquid composition.

* * * * *